US006678216B2

(12) United States Patent
Takahashi

(10) Patent No.: US 6,678,216 B2
(45) Date of Patent: Jan. 13, 2004

(54) TIMEPIECE USING SPRING AS POWER

(75) Inventor: Takashi Takahashi, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/354,573

(22) Filed: Jan. 30, 2003

(65) Prior Publication Data

US 2003/0147310 A1 Aug. 7, 2003

(30) Foreign Application Priority Data

Apr. 2, 2002 (JP) ..... 2002-026880

(51) Int. Cl.[7] ..... G04B 9/00; G04B 5/00; G04C 3/00

(52) U.S. Cl. ..... 368/66; 368/64; 368/203; 368/206; 368/212

(58) Field of Search ..... 368/64, 68, 203–212

*Primary Examiner*—David Martin
*Assistant Examiner*—Michael L. Lindinger

(74) *Attorney, Agent, or Firm*—Adams & Wilks

(57) ABSTRACT

To provide a power accumulation structure of a simple construction, in which a planetary mechanism is not used, for a timepiece using a spring as power. A power accumulation structure of a simple construction not using a planetary mechanism is a power accumulation structure using a threaded mechanism. This power accumulation structure using the threaded mechanism includes a ratchet wheel 1, a barrel complete, an externally threaded wheel supported on a plate and a wheel train receiving member and disposed so as to be meshed with the ratchet wheel, an internally threaded wheel having an internally threaded portion meshed with the externally threaded portion of the externally threaded wheel, a gear portion and a conical portion and disposed so as to be meshed with a gear of the barrel complete, a power accumulation wheel having a cumulative power pointer fixed thereto and an arm engaged with the conical portion of the internally threaded wheel, and a spring member adapted to urge the arm of the power accumulation wheel against the conical portion of the internally threaded wheel.

8 Claims, 5 Drawing Sheets

PRIOR ART

PRIOR ART

TIMEPIECE USING SPRING AS POWER

BACKGROUND OF THE INVENTION

1. Field of the Invention

The present invention relates to a timepiece using a spring as power, and more particularly to a power accumulation structure therefor. The timepieces using a spring as power include a mechanical timepiece adapted to move a pointer, which is supported on a wheel train, by utilizing the mechanical energy of a spring, and an electronically controlled type mechanical timepiece. The electronically controlled type mechanical timepiece is like the timepiece disclosed in JP-A-2000-2773, in which a pointer supported on a wheel train is moved by converting the mechanical energy of a spring being unwound into electric energy, and controlling a value of a current, which flows in a coil of a generator, by operating a rotation control unit by the mentioned electric energy.

2. Description of the Prior Art

A timepiece using a spring as power is provided with a power accumulation structure, i.e. a power reservation structure adapted to indicate a residual cumulative quantity of the spring. A related art power accumulation structure has a complicated construction provided with a planetary mechanism, and is disclosed in JP-A-9-21886, a principal portion of this power accumulation structure being as shown in a sectional view of FIG. 4 and a plan view of FIG. 5.

When a spring is wound up by a ratchet wheel 1 in a related art power accumulation structure, an intermediate planetary gear 5*a* works as a fixed gear of the planetary mechanism, and the rotation of the ratchet wheel 1 is transmitted to a power accumulation wheel 9 via a rotational transmission mechanism including the planetary mechanism. The power accumulation wheel 9 is turned in a predetermined direction, and has a cumulative power pointer 10 indicating that a cumulative quantity of the spring is increasing. A rotation transmission path formed during a spring wind-up operation extends from the ratchet wheel 1 to the power force accumulation wheel 9 via a planetary transmission wheel 3, a second sun gear 4, a first planetary gear 6*a*, a second planetary gear 6*b*, a sun gear 7 and an intermediate power accumulation gear 8.

On the other hand, when a barrel complete 2 is rotated to cause the spring to be unwound, the second sun gear 4 works as a fixed gear of the planetary mechanism, and the rotation of the barrel complete 2 is transmitted to the power accumulation wheel 9 via a rotational transmission mechanism. The power accumulation wheel 9 is turned in the direction contrary to the mentioned predetermined direction, and has the cumulative power pointer 10 indicate that a cumulative quantity of the spring is decreasing. A rotation transmission path formed during a spring unwinding operation extends from the barrel complete 2 to the power accumulation wheel 9 via an intermediate planetary wheel 5, a planetary wheel 6, the sun wheel 7 and an intermediate power accumulation wheel 8. During this time, the planetary wheel 6 orbitally revolves around the sun wheel 7 as the planetary wheel rotates on its own axis.

Thus, in a related art timepiece using a spring as power, a power accumulation structure thereof has a very complicated construction using a rotational transmission mechanism including a planetary mechanism. Therefore, the timepiece has a large number of parts, and needs a large space. The problem to be solved by the present invention is to form without using a complicated planetary mechanism a power accumulation structure of a timepiece using a spring as power.

SUMMARY OF THE INVENTION

To solve these problems, the timepiece using a spring as power according to the present invention is provided with a power accumulation structure formed so that a cumulative power pointer is driven and indicates a cumulative quantity of the spring when the spring is wound up, by converting a quantity of a rotation of a ratchet wheel into a quantity of a forward linear movement thereof by a threaded mechanism including an externally threaded wheel and an internally threaded wheel, converting a quantity of a rotation of a barrel complete when the spring is unwound, into a quantity of a reverse linear movement thereof, and converting the quantities of the linear movements into those of rotations by a relative movement conversion mechanism.

To be more concrete, the timepiece using a spring as power according to the present invention, which solves the above-mentioned problems, is provided with a power accumulation mechanism including a ratchet wheel for winding up a spring constituted as power for the time piece; a barrel complete mounted on the same shaft as the ratchet wheel, and rotated in accordance with a release of the spring; an externally threaded wheel having an externally threaded portion and a gear portion, and disposed so that the externally threaded wheel is meshed at the gear portion thereof with the ratchet wheel; an internally threaded wheel having an internally threaded portion meshed with the externally threaded portion of the externally threaded wheel, a gear portion and a conical portion, and disposed so that the internally threaded wheel is meshed at the gear portion thereof with the barrel complete; a power accumulation wheel having a cumulative power pointer fixed thereto, and a locking arm engaged with the conical portion of the internally threaded wheel; and a spring member adapted to urge the locking arm of the power accumulation wheel against the conical portion of the internally threaded wheel.

In the timepiece using a spring as power according to the present invention, the threaded mechanism including the externally threaded wheel and internally threaded wheel is adapted to convert a quantity of a rotation of the ratchet wheel into a quantity of a perpendicularly downward linear movement of the internally threaded wheel when the spring is wound-up, and convert a rotational quantity of the barrel complete into a quantity of a perpendicularly upward linear movement of the internally threaded wheel when the spring is unwound.

The conical surface of the internally threaded wheel and the locking arm of the power accumulation wheel constitute a mechanism for converting the quantities of the linear movements into those of movements of rotations thereof. A distance between a point at which the locking arm is engaged with the conical surface of the internally threaded wheel and an axis of the externally threaded wheel varies in proportion to a quantity of a vertically linear movement of the internally threaded wheel. Namely, a quantity of a vertically linear movement of the internally threaded wheel is converted into that of a horizontally linear movement of the point at which the locking arm is engaged with the conical surface of the internally threaded wheel. The locking arm is joined to the power accumulation wheel. Therefore, when the locking arm is moved linearly in the horizontal direction, the power accumulation wheel is rotated accordingly in proportion to the mentioned linear movement of the locking arm. Thus, the quantity of a horizontal linear movement of the point at which the locking arm is engaged with the conical surface of the internally threaded wheel is converted into that of a rotational quantity of the power accumulation wheel.

A surface of the conical portion of the internally threaded wheel is a smooth surface, and a free end of the locking arm of the power accumulation wheel is frictionally engaged with the surface of the conical portion of the internally threaded wheel.

In the timepiece using a spring as power according to the present invention, the surface of the conical portion of the internally threaded wheel is provided with a helical groove, and a free end of the locking arm of the power accumulation wheel is engaged with the helical groove of the surface of the conical portion of the power accumulation wheel.

The timepiece using a spring as power is provided with a power accumulation structure including a ratchet wheel for winding up the spring constituted as power for the timepiece; a barrel complete mounted on the same shaft as the ratchet wheel, and rotated in accordance with a release of the spring; an externally threaded wheel having an externally threaded portion, a gear portion and a stopper surface, supported on a wheel train receiving member and a plate, and disposed so that the gear portion and ratchet wheel are meshed with each other; an internally threaded wheel having an internally threaded portion meshed with the externally threaded portion of the externally threaded wheel, a gear portion and a conical portion, and disposed so that the gear portion is meshed with the barrel complete; a power accumulation wheel having a cumulative power pointer fixed thereto, and a locking arm engaged with the conical portion of the internally threaded wheel; and a spring member adapted to urge the locking arm of the power accumulation wheel against the conical portion of the internally threaded wheel, the timepiece being formed so that forward and reverse linear movements of the internally threaded wheel are restricted respectively by the stopper surface formed on the externally threaded wheel and a stopper surface formed on the plate.

A transmission ratio of the externally threaded wheel with respect to the ratchet wheel and that of the internally threaded wheel with respect to the barrel complete is set equal. This is the condition for miniaturizing the constituent parts of the threaded mechanism and those of the mechanism for converting the quantities of linear movements into those of rotations; and minimizing the number of the parts.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

First Mode of Embodiment

Figure 1:
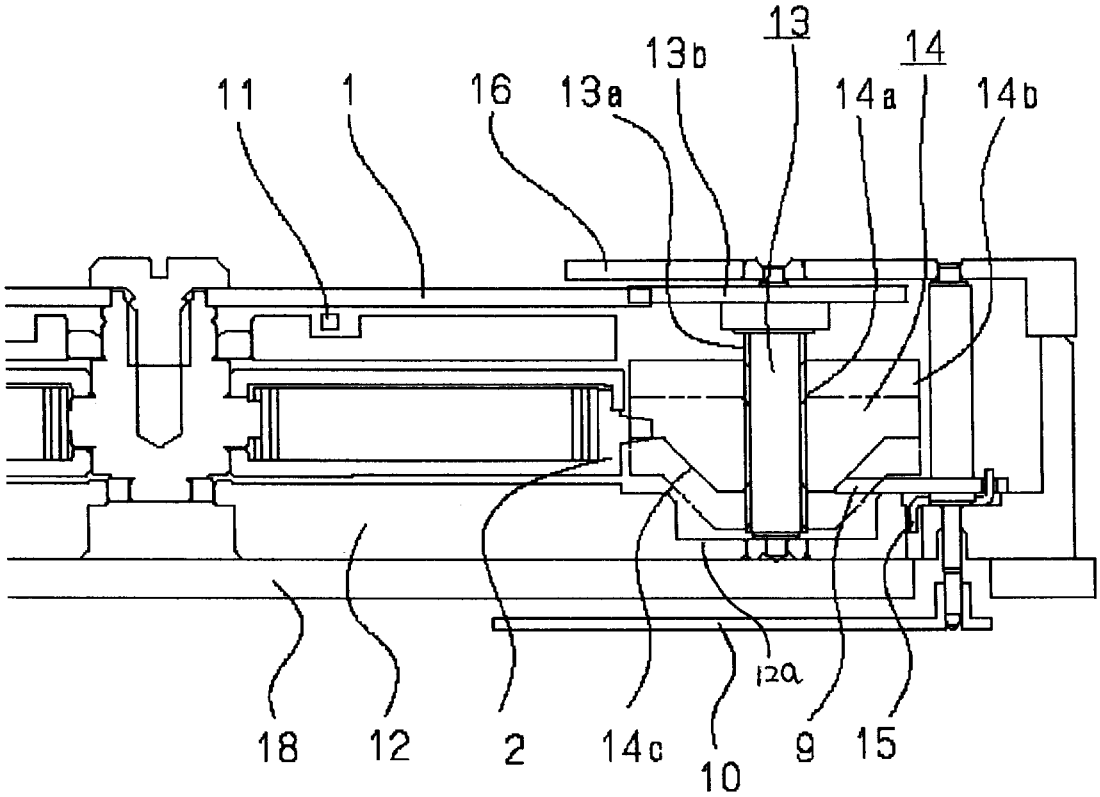
FIG. 1 is a sectional view of a mode of example of the power accumulation structure in the present invention using a threaded mechanism.
Figure 2:
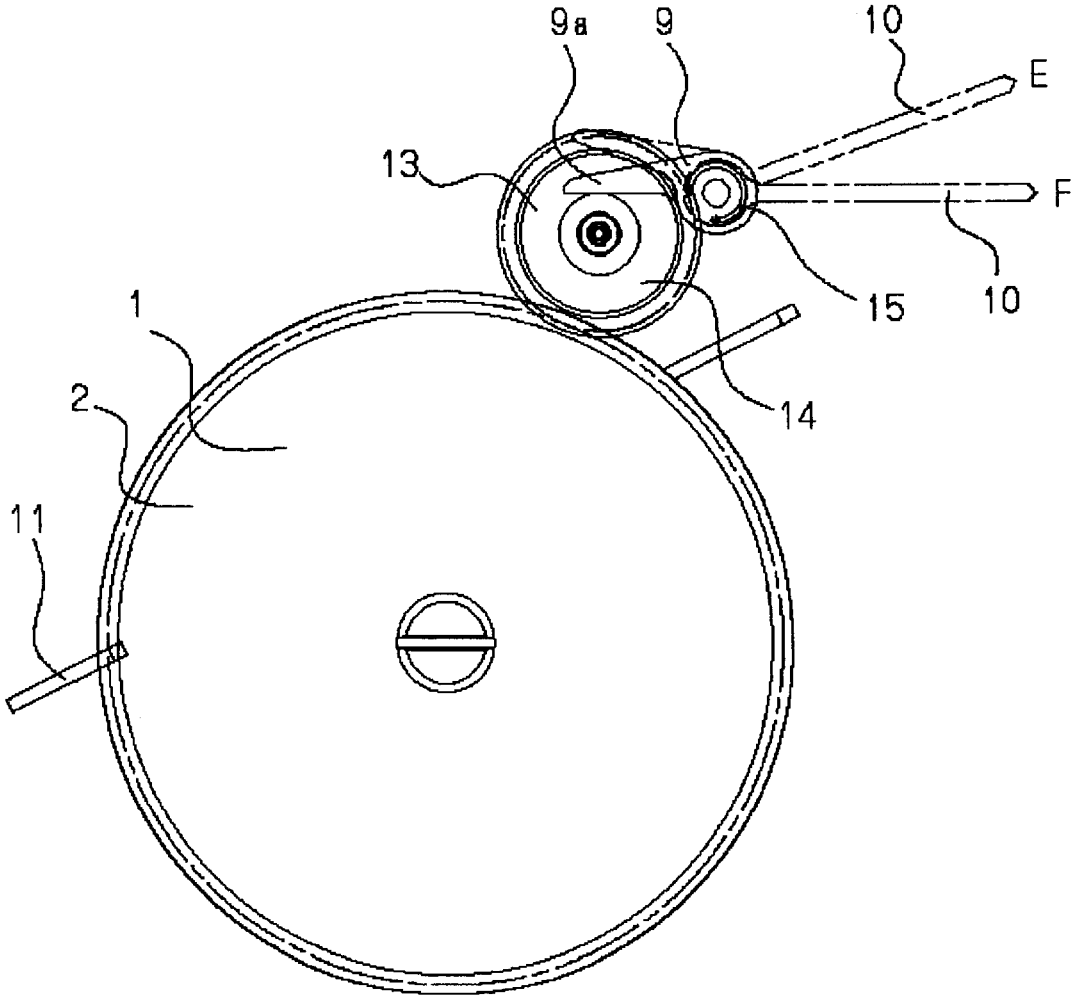
FIG. 2 is a plan view of the same mode of example of the power accumulation structure in the present invention using a threaded mechanism.

A mode of example of a power accumulation structure in the timepiece according to the present invention includes a ratchet wheel 1, a barrel complete 2, an externally threaded wheel 13, an internally threaded wheel 14, a power accumulation wheel 9 and a spring member as shown in FIG. 1, a sectional view, and FIG. 2, a plan view.

The ratchet wheel 1 is a part for winding up a spring constituted as power for the timepiece. The barrel complete 2 is a part mounted on the same shaft as the ratchet wheel 1, and adapted to be rotated in accordance with a release of the spring and thereby drive a timepiece wheel train.

The externally threaded wheel 13 forming a threaded mechanism is a part supported on a plate 12 and a wheel train receiving member 16, and having an externally threaded portion 13*a* of a length nearly equal to a distance between the plate 12 and wheel train receiving member 16, a gear 13*b* meshed with the ratchet wheel 1, an externally threaded portion 13*a* and a gear 13*b*.

Figure 3:
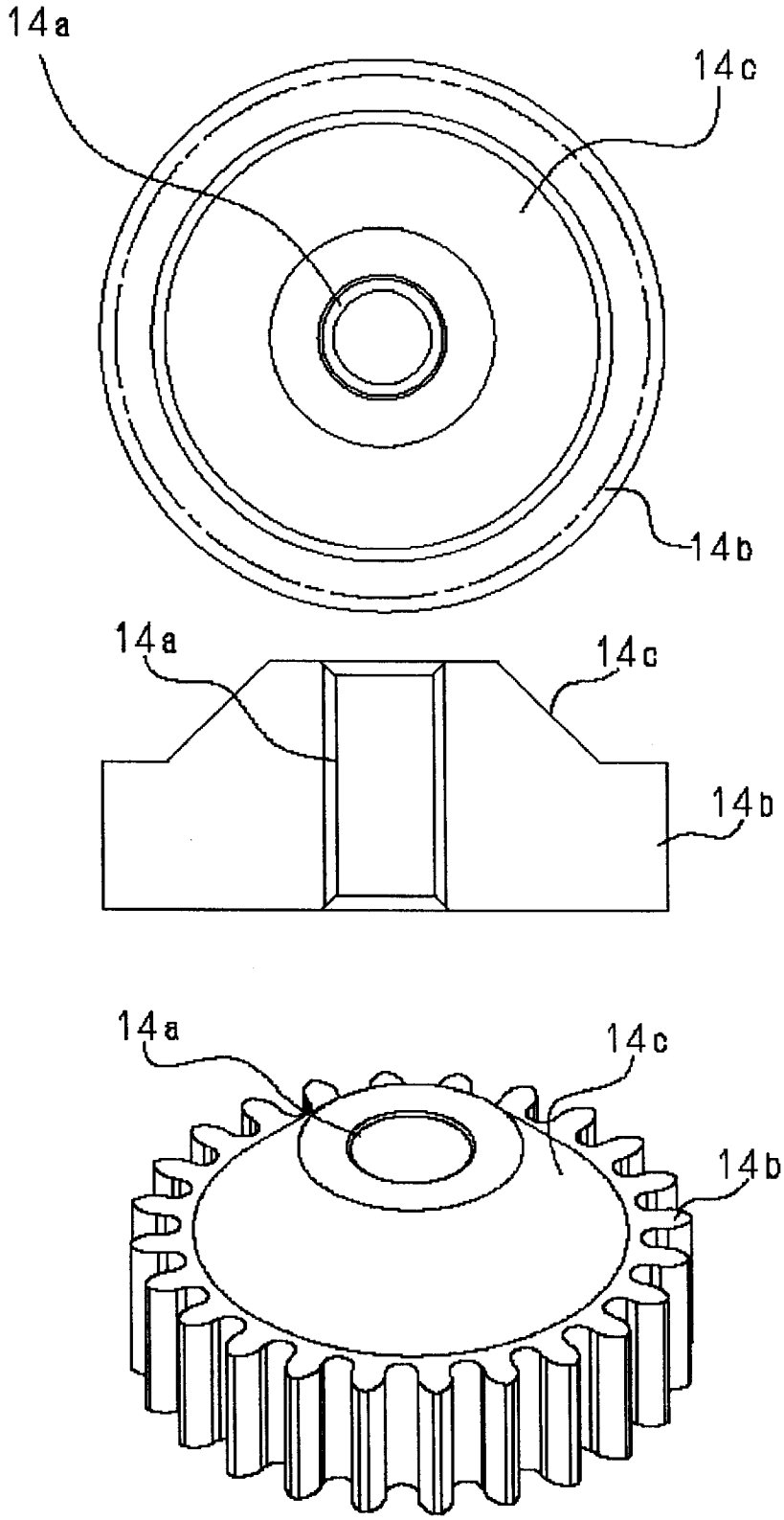
FIG. 3 is a plan view A, a sectional view B and a perspective view C of an example of an internally threaded wheel 14 constituting the threaded mechanism.
Figure 4:
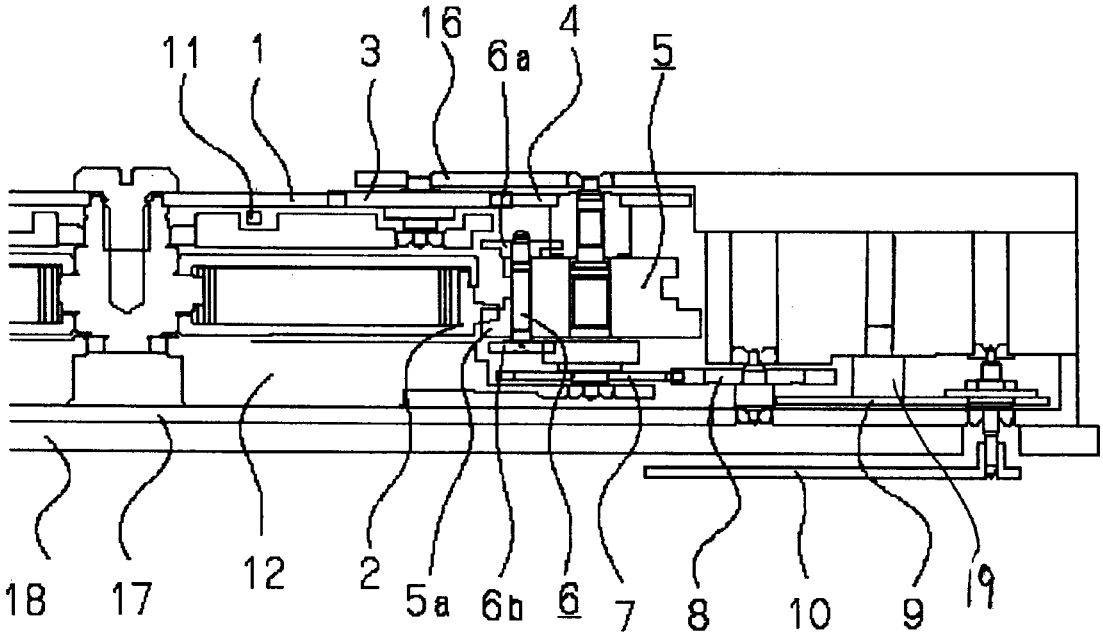
FIG. 4 is a sectional view of a mode of example of a related art power accumulation structure using a planetary mechanism.
Figure 5:
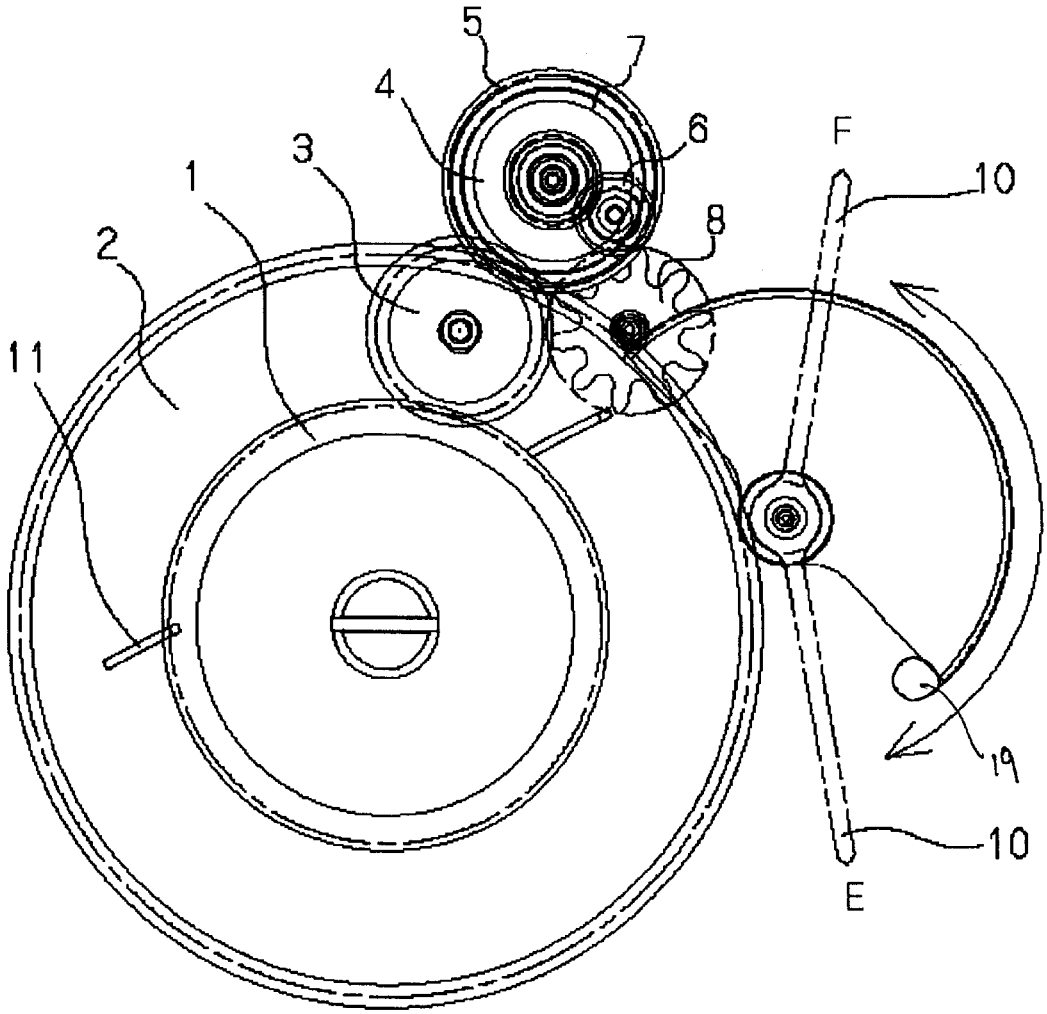
FIG. 5 is a plan view of the same mode of example of the related art power accumulation structure using a planetary mechanism.

As shown in FIG. 3, a plan view A, a sectional view B, and a perspective view C, the externally threaded wheel 14 constituting the threaded mechanism is a substantially conical part, and has an internally threaded portion 14*a* meshed with the externally threaded portion 13*a* of the externally threaded wheel 13, a gear 14*b* meshed with a gear of the barrel complete 2, and a conical portion 14*c* engaged with the power accumulation wheel 9. An axial length of the internally threaded wheel 14 is around a half of a length of the externally threaded wheel 13, and is determined in the design stage of the timepiece.

The construction of the power accumulation wheel 9, one part constituting a power accumulation structure in the present invention is different from that of the same part in related art. Namely, as shown in FIG. 1, a sectional view, and FIG. 2, a plan view, the power accumulation wheel 9 is a part having an arm 9*a* constituting a conversion mechanism adapted to convert a linear movement into a rotational movement. The power accumulation wheel 9 is disposed so that a locking surface of the arm 9*a* is engaged with the conical portion 14*c* of the internally threaded wheel 14. A spring member 15 wound around the power accumulation wheel 9 functions as a device for constantly urging the locking surface of the arm 9*a* against a tapering surface of the conical portion 14*c* of the internally threaded wheel 14.

A transmission ratio of the externally threaded wheel 13 with respect to the ratchet wheel 1 and that of the internally threaded wheel 14 with respect to the barrel complete 2 are set equal. The reason why these transmission ratios are set equal resides in miniaturizing the constituent parts of the threaded mechanism and those of a mechanism for converting quantities of linear movements into that of rotation; and minimizing the number of the parts.

When the spring is wound up by the ratchet wheel 1 in the power accumulation structure for the timepiece of the above-described construction, the rotation of the ratchet wheel 1 is transmitted to the power accumulation wheel 9 via a rotational transmission mechanism including a threaded mechanism and a mechanism for converting a quantity of linear movement into that of rotation, and the power accumulation wheel 9 is turned in a predetermined direction to have the cumulative power pointer 10 indicate that a cumulative quantity of the spring is increasing. A rotation transmission path formed when the spring is wound up extends from the ratchet wheel 1 to the power accumulation wheel 9 via the externally threaded wheel 13 and internally threaded wheel 14. Namely, during a spring wind-up operation, the rotation of the ratchet wheel 1 is transmitted to the externally threaded wheel 13, and the internally threaded wheel 14 is lowered along the meshing axis thereof by the rotation of the externally threaded wheel 13. The quantity of the downward movement of the internally threaded wheel 14 is proportional to that of the rotation of the ratchet wheel 1. The arm 9*a* of the power accumulation wheel 9 is engaged with the conical portion 14*c* of the internally threaded wheel 14 so that the power accumulation wheel 9 is turned correspondingly to the quantity of the downward movement of the internally threaded wheel 14. Therefore, the cumulative power pointer 10 fixed to the power accumulation wheel 9 is moved in the direction F in which a cumulative quantity of the spring increases, and indicates a residual level of the cumulative quantity of the spring.

On the other hand, when the barrel complete 2 is rotated to cause the spring to be unwound, the rotation of the barrel complete 2 is transmitted to the power accumulation wheel 9 via the above-mentioned rotational transmission mechanism, and the power accumulation wheel 9 is turned in the direction contrary to the above-mentioned predetermined direction to have the cumulative power pointer 10 indicate that a quantity of accumulation of the spring is decreasing. A rotation transmission path formed when the spring is unwound, extends from the barrel complete 2 to the power accumulation wheel 9 via the internally threaded wheel 14. Namely, during a spring unwinding operation, the rotation of the barrel complete 2 is transmitted directly to the internally threaded wheel 14, which is moved up along an axis of meshing of the externally threaded wheel as the internally threaded wheel 14 is rotated. The quantity of the upward movement of the internally threaded wheel 14 is proportional to that of rotation of the barrel complete 2. The arm 9*a* of the power accumulation wheel 9 is engaged with the conical portion 14*c* of the internally threaded wheel 14 so that the power accumulation wheel 9 is turned correspondingly to the quantity of the upward movement of the internally threaded wheel 14. Accordingly, the cumulative power pointer 10 fixed to the power accumulation wheel 9 is moved in the direction E in which the quantity of accumulation of the spring decreases, to indicate a residual level of the quantity of accumulation of the spring.

As is clear from the above statement, the threaded mechanism is a mechanism for converting a quantity of rotation into that of a linear movement, i.e., for converting a quantity of a rotation of the ratchet wheel 1 into that of a vertically downward linear movement of the internally threaded wheel 14 when the spring is wound up, and a quantity of a rotation of the barrel complete 2 into that of a vertically upward linear movement of the internally threaded wheel 14 when the spring is unwound.

The conical portion 14*c* of the internally threaded wheel 14 and the locking arm 9*a* of the power accumulation wheel 9 constitute a mechanism for converting the above-mentioned quantity of a linear movement into a quantity of rotation. A distance between a point at which the locking arm 9*a* is engaged with the conical portion 14*c* and the center of axis of the externally threaded wheel 13 varies in proportion to a quantity of a vertical linear movement of the internally threaded wheel 14. Namely, a quantity of a vertical linear movement of the internally threaded wheel 14 is converted into that of a horizontal linear movement of a point at which the locking arm 9*a* is engaged with the conical portion 14*c*. The locking arm 9*a* is fixed to the power accumulation wheel 9. Therefore, when the locking arm 9*a* is moved linearly in the horizontal direction, the power accumulation wheel 9 is rotated proportionally in accordance with the movement of the locking arm 9*a*. Thus, a quantity of a horizontal linear movement of the point at which the locking arm 9*a* is engaged with the conical portion 14*c* is converted into that of rotation of the power accumulation wheel 9.

As is understood from the above statement, the conical portion 14*c* of the internally threaded wheel 14 is adapted to linearly convert a quantity of a vertical linear movement of the internally threaded wheel 14 into that of a horizontal linear movement thereof. Therefore, it is possible to set the inclination of the conical portion 14*c* non-linear, if necessary, and not linear as shown in FIG. 3, convert a quantity of a vertical linear movement of the internally threaded wheel 14 non-proportionally into that of a horizontal linear movement thereof, and thereby render the rotation of the power accumulation wheel 9 non-proportional. This enables a movement of the pointer during a period of time near the termination of the unwinding of the spring to be displayed in detail.

The mechanism for converting the quantity of a linear movement into that of a rotation is formed by the conical portion 14*c* of the internally threaded wheel 14 and the locking arm 9*a* of the power accumulation wheel 9. The surface of the conical portion 14*c* of the internally threaded wheel 14 is smooth, and the free end of the locking arm 9*a* of the power accumulation wheel 9 is frictionally engaged with the surface of the conical portion 14*c*. The surface of the conical portion 14*c* of the internally threaded wheel 14 may be provided with a helical groove, with which the free end of the locking arm 9*a* of the power accumulation wheel 9 may be engaged.

Second Mode of Embodiment

A timepiece of a second mode of embodiment of the present invention is a timepiece using a spring as power, provided with a power accumulation structure including a ratchet wheel for winding up a spring constituted as power for the timepiece; a barrel complete mounted on the same shaft as the ratchet wheel, and rotated in accordance with a release of the spring; an externally threaded wheel having an externally threaded portion and a gear portion, and disposed so that the externally threaded wheel is meshed at the gear portion thereof with the ratchet wheel; an internally threaded wheel having an internally threaded portion meshed with the externally threaded portion of the externally threaded wheel, a gear portion and a conical portion, and disposed so that the internally threaded wheel is meshed at the gear portion thereof with the barrel complete; a power accumulation wheel having a cumulative power pointer fixed thereto, and a locking arm engaged with the conical portion of the internally threaded wheel; and a spring member adapted to urge the locking arm of the power accumulation wheel against the conical portion of the internally threaded wheel, stoppers for restricting forward and reverse linear movements of the internally threaded wheel 14 respectively being added. These stoppers are a stopper surface 13*c* formed on the externally threaded wheel 13 and used when the spring is unwound, and a stopper surface 12*a* formed on the plate 12 and used when the spring is wound up.

The stopper surface 13*c* used when the spring is unwound is formed by setting a diameter of a columnar portion between the externally threaded portion 13*a* and gear portion 13*b* larger than that of the externally threaded portion 13*a*, and smaller than that of an upper end surface of the internally threaded wheel 14. In other words, the stopper surface 13*c* used when the spring is unwound is an annular stepped portion formed on a boundary between the externally threaded portion 13*a* and the large-diameter columnar portion. This annular stopper surface 13*c* functions as a stopper receiving the annular upper end surface of the internally threaded wheel 14, i.e., as a stopper used when the spring is unwound.

The stopper surface 12*a* corresponds to a circumference of an externally threaded wheel supporting portion of the plate 12, and is formed on the portion of an upper surface of the plate 12 which is opposed to an annular lower end surface of the internally threaded wheel 14. The stopper surface 12*a* formed on the plate 12 functions as a stopper receiving the annular lower end surface of the internally threaded wheel 4 forming the threaded mechanism, i.e., as a stopper used when the spring is wound up. In the time piece according to the present invention, a barrel complete in which an inner surface thereof and an outermost end of the spring are fixed to each other is provided, as well as a stopper which is used when the spring is wound up. In a time piece using a spring of the above-described construction as a power source, the spring is held in a barrel complete 2 without providing an outer fastener, and a power accumulation structure is formed by using a rotational transmission mechanism including a simple threaded mechanism, quantities of forward and reverse movements of an internally threaded wheel 14 in the threaded mechanism which functions as a mechanism for converting a quantity of rotation into that of a linear movement being restricted by respective stoppers. Therefore, as compared with a related art timepiece in which a spring held in a barrel complete with an outer fastener provided thereon is used as power, the spring can be utilized as power more by a number of turn thereof corresponding to the dimensions of a space occupied by the outer fastener as an effective number of turn of the spring. Accordingly, in the case of a mechanical timepiece using a spring as power, an increase in duration of around 6 to 7 hours is obtained.

As described in detail above, the timepiece using a spring as power is a timepiece provided with a power accumulation structure formed so that the power accumulation structure is operated by converting a quantity of a rotation of a ratchet wheel when the spring is wound up into that of a forward linear movement thereof by a threaded mechanism including an externally threaded wheel 13 and an internally threaded wheel 14, converting a quantity of a rotation of a barrel complete 2 when the spring is unwound into that of a reverse linear movement thereof by the same threaded mechanism, further converting the quantities of the linear movements into those of rotational movements by a mechanism for converting a quantity of a linear movement into that of a rotation, and thereby drive a cumulative power pointer 10 to indicate a quantity of cumulative power of the spring.

Although the threaded mechanism in each of the modes of embodiments of the present invention includes an externally threaded wheel 13 supported on a plate 12 and a wheel train receiving member 16, and an internally threaded wheel 14 meshed with an externally threaded portion 13*a* of the externally threaded wheel 13, various modifications can be made. For example, the conical internally threaded wheel 14 shown in FIG. 1 is disposed so that a larger-diameter portion thereof be positioned on the upper side with a smaller-diameter portion thereof positioned on the lower side. This conical wheel can be disposed upside down. However, in this case, the direction of a rotation of the power accumulation wheel 9 is reversed as compared with that thereof shown in FIG. 1. In the embodiment of FIG. 1, the externally threaded wheel 13 is disposed so that it is meshed with the ratchet wheel 1, and the internally threaded wheel 14 so that it is meshed with the barrel complete 2, to form the threaded mechanism. These wheels 13, 14 may be disposed reversely, if necessary. Namely, the present invention can also employ a structure in which the externally threaded wheel 13 is disposed so as to be meshed with the barrel complete 2 with the internally threaded wheel 14 disposed so as to be meshed with the ratchet wheel 1.

Owing to the present invention, a timepiece having a power accumulation structure formed by using a rotational transmission mechanism including not a planetary mechanism of a complicated construction but a simple threaded structure could be provided. When the power accumulation structure in the present invention formed by including the threaded structure was compared with a related art power accumulation structure formed by including a planetary mechanism, it was proven that the former had a very simple construction, and attained the facilitation of the production of the parts thereof, and the reduction of the number of the parts and the cost of the timepiece using a spring as power.

Furthermore, the timepiece using a spring as power according to the present invention enables the spring to be held in the barrel complete without providing an outer fastener on the barrel complete. Therefore, an effective number of turns of the spring wound up and unwound in the barrel complete was utilized maximally as power.

Namely, the space size of which had been smaller due to the outer fastener provided on the portion of the spring in the barrel complete which is at the vicinity of the outermost edge of the spring can contain an increased number of turns of the spring. Therefore, an improvement of the duration of the spring of about 6 to 7 hours can be attained.

The timepiece using a spring as power according to the present invention is provided with a stopper on an unwinding side of the spring. This enabled a position of the cumulative power pointer to be set on a dial without deflecting the pointer from a zero indicating position.

A timepiece using a rotational transmission mechanism including the above-mentioned planetary mechanism and provided with a related art power accumulation structure stops generally with a pointer exceeding a graduation on the side (EMPTY) which indicates a maximum quantity of unwinding of the spring. Therefore, uncertainty existed in the duration display function of the timepiece.

A slipping attachment for an automatic winding structure provided in the vicinity of the outermost edge of a spring in a barrel complete, and an outer fastener for a manual winding structure are necessary parts for preventing parts from being broken, and also cause a decrease in an effective number of turns of the spring in the barrel complete. The decreased effective number of turns causes the duration of about 12 to 14 hours to be lost in the case of a timepiece provided with a slipping attachment for an automatic winding structure, and about 6 to 7 hours in the case of a timepiece provided with an outer fastener for manual winding structure. According to the present invention, decreasing the effective number of turns becomes unnecessary owing to the provision of stoppers, so that such time as is lost in a related art timepiece can be added to the duration.

What is claimed is:

1. A timepiece using a spring as power comprising:

a power accumulation structure formed so that the power accumulation structure for converting a quantity of a rotational movement of a ratchet wheel when the spring is wound up into that of forward linear movement of the threaded mechanism including an externally threaded wheel and an internally threaded wheel, converting a quantity of a rotational movement of a barrel complete when the spring is unwound into that of reverse linear movement of the same threaded mechanism, further converting the quantities of the linear movements into those of rotational movements by a mechanism for converting a quantity of a linear movement into that of a rotational movement, and thereby drive a cumulative power pointer to indicate a quantity of cumulative power of the spring.

2. A timepiece using a spring as power comprising:

a power accumulation structure including a ratchet wheel for winding up a spring constituted as power for the timepiece;

a barrel complete mounted on the same shaft as the ratchet wheel, and rotated in accordance with a release of the spring;

an externally threaded wheel having an externally threaded portion and a gear portion, and disposed so that the externally threaded wheel is meshed at the gear portion thereof with the ratchet wheel;

an internally threaded wheel having an internally threaded portion meshed with the externally threaded portion of the externally threaded wheel, a gear portion and a conical portion, and disposed so that the internally threaded wheel is meshed at the gear portion thereof with the barrel complete;

a power accumulation wheel having a cumulative power pointer fixed thereto, and a locking arm engaged with the conical portion of the internally threaded wheel; and a spring member adapted to urge the locking arm of the power accumulation wheel against the conical portion of the internally threaded wheel.

3. A timepiece using a spring as power according to claim 2, wherein a surface of the conical portion of the internally threaded wheel is a smooth surface, a free end of the locking arm of the power accumulation wheel being frictionally engaged with the smooth surface.

4. A timepiece using a spring as power according to claim 2, wherein the surface of the conical portion of the internally threaded wheel is provided with a helical groove, the free end of the locking arm of the power accumulation wheel being engaged with the helical groove.

5. A timepiece using a spring as power comprising:

a power accumulation structure including a ratchet wheel for winding up a spring constituted as power for the timepiece;

a barrel complete mounted on the same shaft as the ratchet wheel, and rotated in accordance with a release of the spring;

an externally threaded wheel having an externally threaded portion, a gear portion and a stopper surface, supported on a wheel train receiver and a plate, and disposed so that the gear portion and ratchet wheel are meshed with each other;

an internally threaded wheel having an internally threaded portion meshed with the externally threaded portion of the externally threaded wheel, a gear portion and a conical portion, and disposed so that the gear portion is meshed with the barrel complete;

a power accumulation wheel having a cumulative power pointer fixed thereto, and a locking arm engaged with the conical portion of the internally threaded wheel; and a spring member adapted to urge the locking arm of the power accumulation wheel against the conical portion of the internally threaded wheel, the timepiece being formed so that forward and reverse linear movements of the internally threaded wheel are restricted respectively by the stopper surface formed on the externally threaded wheel and a stopper surface formed on the internally threaded wheel.

6. A timepiece using a spring as power comprising:

a power accumulation structure including a ratchet wheel for winding up a spring constituted as power for the timepiece;

a barrel complete mounted on the same shaft as the ratchet wheel, and rotated in accordance with a release of the spring;

an externally threaded wheel having an externally threaded portion, a gear portion and a stopper surface, supported on a wheel train receiving member and a plate, and disposed so that the gear portion is meshed with the ratchet wheel; and an internally threaded wheel having an internally threaded portion meshed with the externally threaded portion of the externally threaded wheel, a gear portion, a conical portion and a stopper portion, and disposed so that the gear portion is meshed with the barrel complete;

a power accumulation wheel having a cumulative power pointer fixed thereto, and a locking arm engaged with the conical portion of the internally threaded wheel; and a spring member adapted to urge the locking arm of the power reserve wheel against the conical portion of the internally threaded wheel, the timepiece being formed so that a forward linear movement of the internally threaded wheel is restricted by the stopper surface formed on the internally threaded wheel and a stopper surface formed on the plate respectively.

7. A timepiece using a spring as power according to claim 2, wherein a transfer ratio of the externally threaded wheel with respect to the ratchet wheel and that of the internally threaded wheel with respect to the barrel complete are equal to each other.

8. A timepiece using a spring as power according to claim 5, wherein a transfer ratio of the externally threaded wheel with respect to the ratchet wheel and that of the internally threaded wheel with respect to the barrel complete are equal to each other.

* * * * *